US005590425A

United States Patent [19]

Janik, Jr.

[11] Patent Number: 5,590,425

[45] Date of Patent: Jan. 7, 1997

[54] HYGIENE TOILET SEAT HANDLE

[76] Inventor: Ernest A. Janik, Jr., 325 N. St. Paul Suite 2626, Dallas, Tex. 75201

[21] Appl. No.: 658,746

[22] Filed: Jun. 5, 1996

Related U.S. Application Data

[60] Continuation of Ser. No. 420,250, Apr. 11, 1995, abandoned, which is a division of Ser. No. 274,704, Jul. 14, 1994, abandoned.

[51] Int. Cl.[6] ..... A47K 13/10

[52] U.S. Cl. ..... 4/246.1

[58] Field of Search ..... 4/246.1

[56] References Cited

U.S. PATENT DOCUMENTS

| | | | |
|---|---|---|---|
| D. 273,128 | 3/1984 | Roddick | D23/71 |
| D. 276,762 | 12/1984 | Parrochia | D3/54 |
| D. 288,471 | 2/1987 | Gladstone | D23/71 |
| 3,191,193 | 6/1965 | Bogenberger | 4/246.1 |
| 3,717,884 | 2/1973 | Mantooth | 4/237 |
| 3,783,455 | 1/1974 | Vanderbrook | 4/1 |
| 3,935,601 | 2/1976 | Hermann | 4/251 |
| 4,129,907 | 12/1978 | Vaughan et al. | 4/251 |
| 4,574,401 | 3/1986 | Nakajima | 4/251 |
| 4,742,582 | 5/1988 | Giallourakis | 4/251 |
| 4,805,246 | 2/1989 | De Vargas et al. | 4/251 |
| 5,065,460 | 11/1991 | Currin | 4/251 |
| 5,086,523 | 2/1992 | De Mott et al. | 4/251 |

FOREIGN PATENT DOCUMENTS

| | | | |
|---|---|---|---|
| 9111949 | 8/1991 | WIPO | 4/246.1 |

*Primary Examiner*—Charles E. Phillips

*Attorney, Agent, or Firm*—H. Dennis Kelly; Timmons & Kelly

[57] ABSTRACT

A wafer container is permanently connected to a handle, and temporarily attached to the underside of a toilet seat or lid. The wafer container is attached to a base that is permanently connected to the toilet seat. The base has a top, two sides and two bottoms pieces, forming an opening into which the wafer container is telescopically inserted. The handle may be made of a substance that glows in the dark, and may be coated and treated with a disinfecting material. The wafer container holds a wafer, which gradually emits deodorizing and disinfecting vapors.

6 Claims, 5 Drawing Sheets

HYGIENE TOILET SEAT HANDLE

This application is a continuation of application Ser. No. 08/420,250, filed Apr. 11, 1995, now abandoned which is a division of Ser. No. 08/274,704, filed Jul. 14, 1994, now abandoned.

BACKGROUND OF THE INVENTION

1. Field of the Invention

This invention relates in general to handles for toilet seats and covers. In particular, the invention relates to a treated hygiene toilet seat handle containing a wafer for deodorizing and disinfecting the toilet bowl.

2. Description of Related Art

U.S. Pat. No. 3,191,193, issued Jun. 29, 1965, to Bogenberger, discloses a toilet seat handle containing a deodorizing and disinfecting wafer. The handle attaches to the underside of the toilet seat, and extends outward beyond the edge of the toilet seat.

Several other types of toilet seat handles have been designed. Most, however, are not treated with a disinfectant, and lack the capability of holding a water. Those that do contain wafers are generally fairly complicated, and it is difficult to replace the wafer.

SUMMARY OF THE INVENTION

The general object of the hygiene toilet seat handle of the invention is to provide a hygiene handle that is treated with a disinfectant and contains an easily replaceable deodorizing and disinfecting wafer. In general, this object is accomplished by a treated toilet seat handle having a wafer container connected to a handle. The wafer container is temporarily attached to the toilet seat, either directly, or through a base that is permanently attached to the seat.

Also, the handle may be additionally treated with a substance that makes the handle glow in the dark. Thus, the handle is easily seen even in low light.

The above, as well as additional objects, features, and advantages of the invention will become apparent in the following detailed description.

DESCRIPTION OF THE PREFERRED EMBODIMENT

The preferred embodiment of the hygiene toilet seat handle 11 of the invention is illustrated in FIGS. 1-10. The hygiene toilet seat handle 11 has a handle 13, a wafer container 15, and a base 17.

Figure 8:
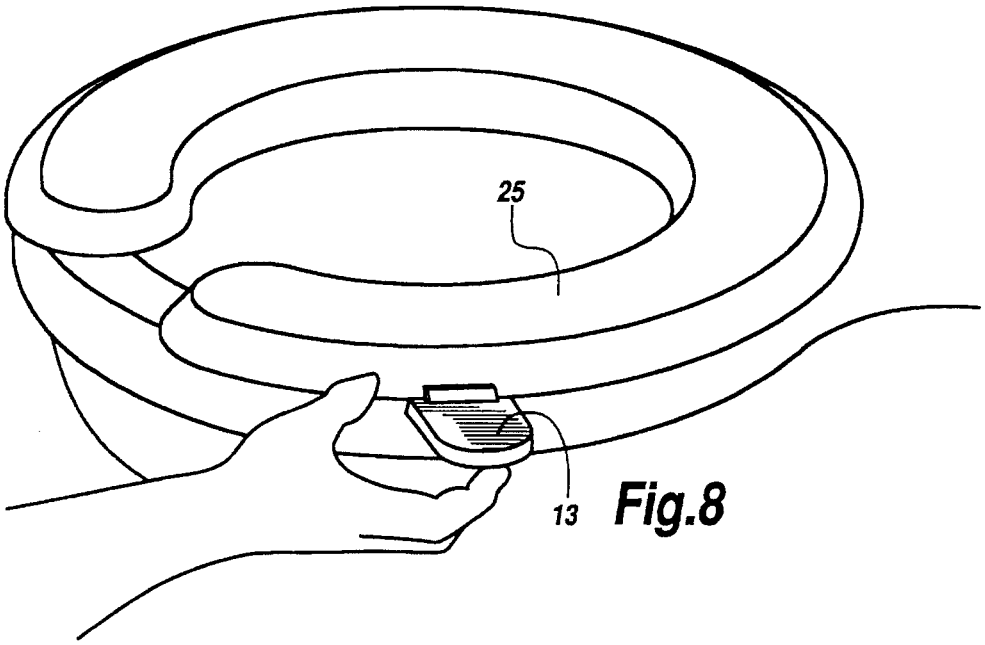
FIG. 8 is a perspective view of a hygiene toilet seat handle attached to a standard toilet seat.

The handle 13 has a flat, semi-oval body 19, large enough to be easily grasped by hand. The handle 13 also has an upper shoulder 21 and a lower shoulder 23. When the handle 13 is inserted into the base 17, the shoulders 21 and 23 abut the base 17, and properly position the handle 13 relative to the base 17. The upper shoulder 21 also abuts the edge of the toilet seat 25, as shown in FIG. 8. The body 19 of the handle 13 extends outward several inches beyond the edge of the toilet seat 25.

The handle 13 may be made of a light-weight, durable plastic material. Also, if desired, the handle 13 may be made of a phosphorescent material that glows in the dark. Additionally, the handle 13 may be impregnated and covered with a disinfecting agent to kill germs, viruses, and bacteria. The phosphorescent material may have a life expectancy similar to the life expectancy of the disinfecting agent.

Figure 6:
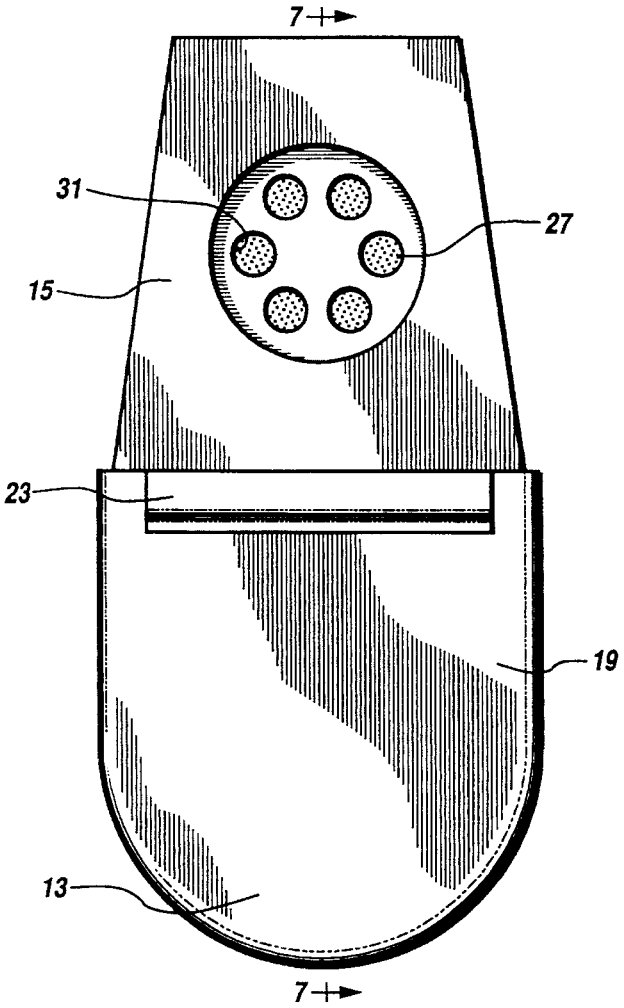
FIG. 6 is a bottom plan view of the handle and wafer container portions of the hygiene toilet seat handle.
Figure 7:
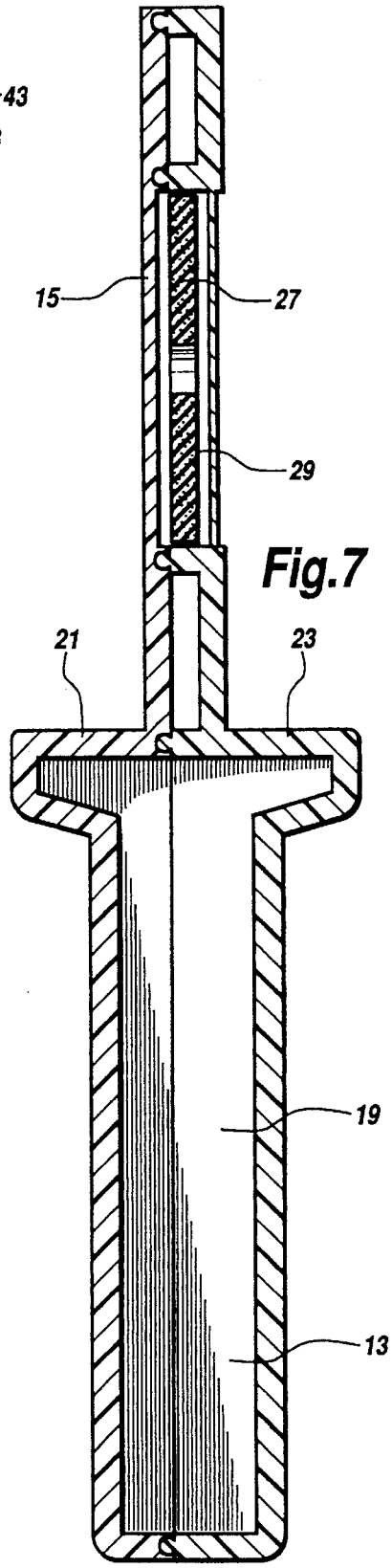
FIG. 7 is an enlarged, cross-sectional side view of the handle and wafer container portions.

As seen best in FIGS. 6 and 7, the wafer container 15 has a flat, trapezoidal shape, with the larger parallel side adjacent to the handle 13. The wafer container 15 holds a deodorizing or disinfecting wafer 27. The wafer container 15 is made of a light-weight, durable plastic material, and can be easily snapped open and shut to replace the wafer 27. The wafer container 15 could also be secured by screws or by other equivalent means.

Figure 4:
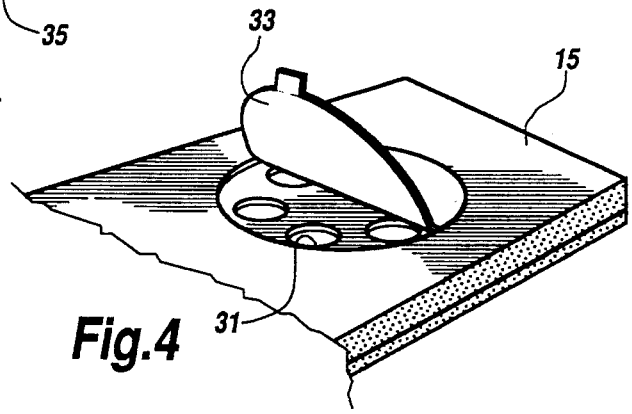
FIG. 4 is a partial perspective view of the container, showing a removable cover over the holes in the wafer container.

The wafer 27 is contained within a wafer chamber 29 that is flat and circular, slightly larger than the wafer 27. A plurality of holes 31 in the wafer container 15 allow the deodorizing and disinfecting vapors to escape the wafer chamber 29 as the wafer 27 vaporizes. A removable cover 33, shown in FIG. 4, is placed over the holes 31 until just before the hygiene toilet seat handle 11 is installed. The cover 33 is then removed and discarded.

Figure 1:
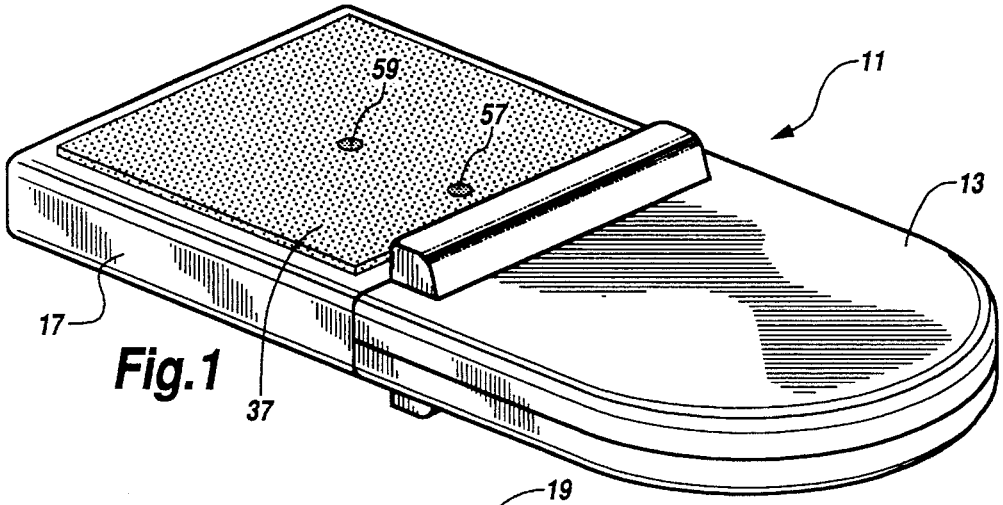
FIG. 1 is a perspective view of a hygiene toilet seat handle according to the invention.
Figure 2:
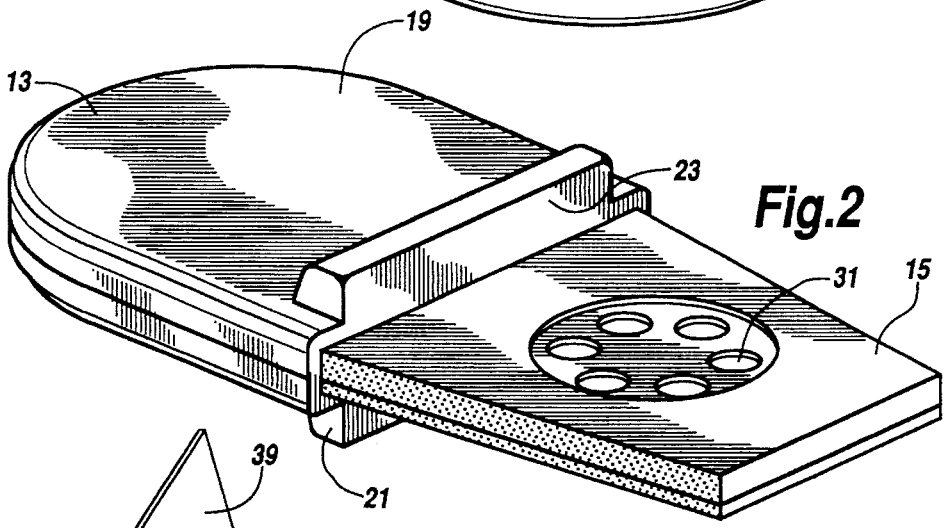
FIG. 2 is a reverse perspective view of the handle and wafer container portions of the hygiene toilet seat handle.
Figure 3:
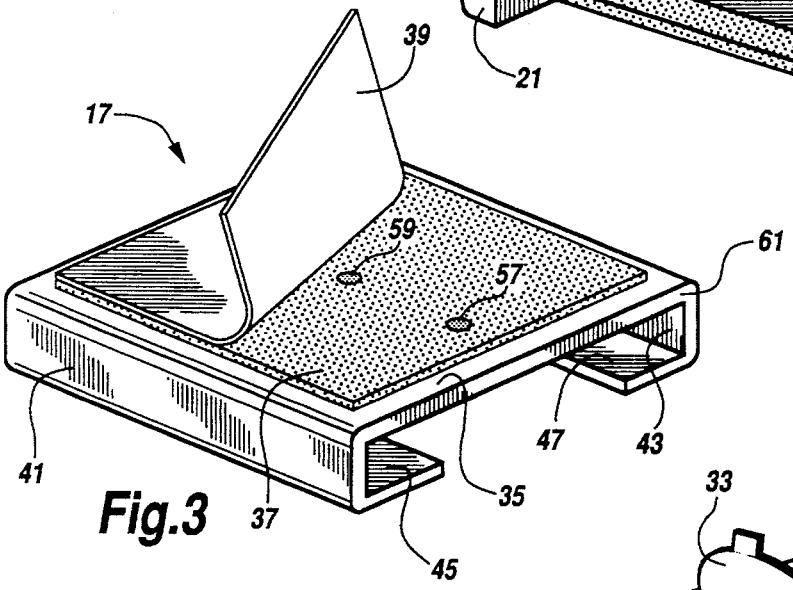
FIG. 3 is a perspective view of the base, showing a cover over the adhesive on the base.

The base 17 has a flat, square top 35 that is about 5 centimeters square. A piece of adhesive material 37, slightly smaller than the top 35 of the base 17, is attached to the top 35 of the base 17. A cover 39, shown in FIG. 3, is placed over the adhesive 37 until the base 17 is about to be installed. The cover 39 is then removed and discarded.

The base 17 also has a pair of sides 41 and 43, extending downward from each side of the base top 35. The sides 41 and 43 extend the length of the top 35 and are about one centimeter wide.

Figure 5:
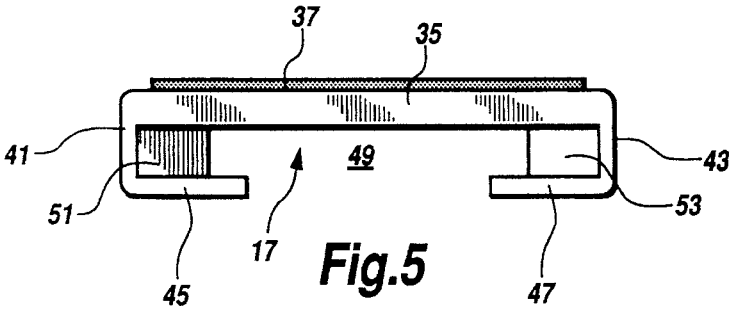
FIG. 5 is an end elevation of the base.

A pair of bottom pieces 45 and 47 are attached to the sides 41 and 43 of the base 17. The bottom pieces 45 and 47 extend the length of the sides 41 and 43, and are about one centimeter wide. The top 35, sides 41 and 43, and bottom pieces 45 and 47 of the base 17 form a rectangular opening 49, into which the wafer container 15 fits telescopically. As shown in FIG. 5, a pair of pads 51 and 53 are mounted within the opening 49 to temporarily secure the wafer container 15 within the opening 49 of the base 17.

Figure 9:
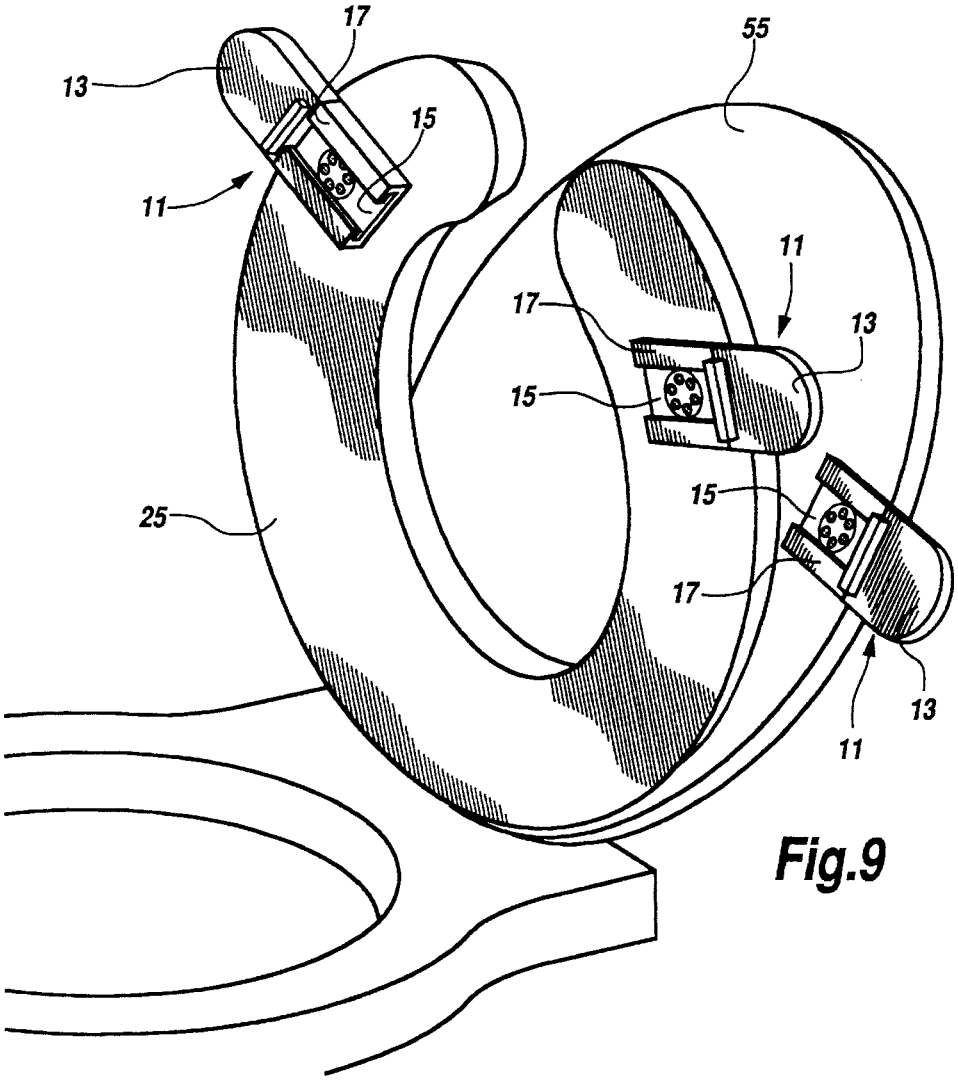
FIG. 9 is a perspective view of several hygiene toilet seat handles, attached to a toilet seat and to a toilet lid.
Figure 10:
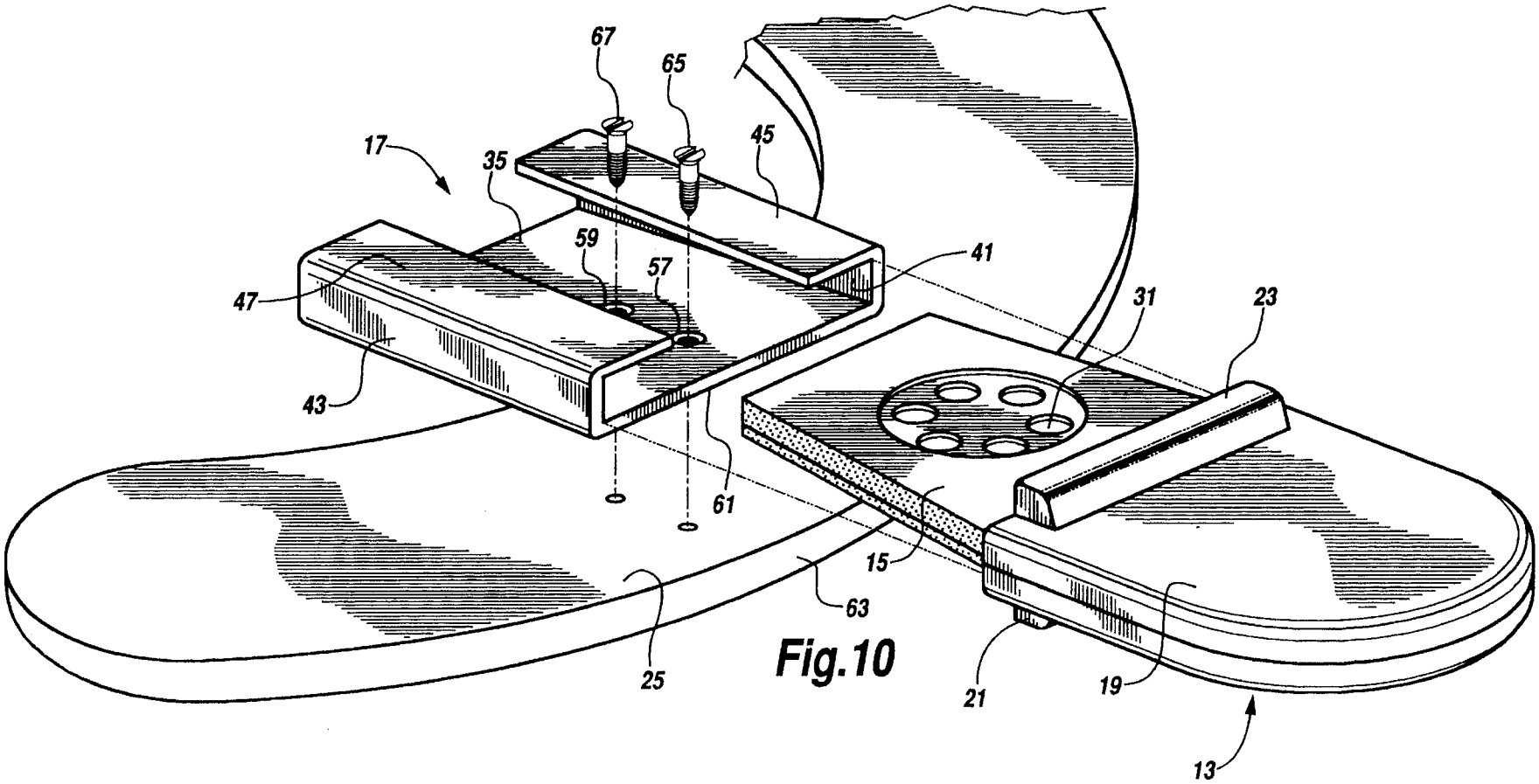
FIG. 10 is a perspective view, showing the installation of a hygiene toilet seat handle onto a toilet seat.

FIG. 10 illustrates the installation of the hygiene toilet seat handle 11 on a standard toilet seat 25. The hygiene toilet seat handle 11 could also be installed on a toilet seat cover 55, as seen in FIG. 9.

The top 35 of the base 17 has a pair of screw holes 57 and 59. After the cover 39 is removed from the adhesive 37, the base 17 is stuck to the underside of the toilet seat 25. The base 17 is positioned with the edge 61 of the base 17 aligned with the edge 63 of the toilet seat 25. Then, two screws 65 and 67 are driven through the screw holes 57 and 59 into the toilet seat 25, to permanently mount the base 17 on the toilet seat 25.

The wafer container 15 is then inserted into the opening 49 of the base 17, until the shoulders 21 and 23 on the handle 13 abut the edge 61 of the base 17. The pads 51 and 53 temporarily hold the wafer container 15 in the base 17. When the wafer 27 has completely vaporized, the wafer container 15 can be easily removed and opened, and the wafer replaced.

Figure 11:
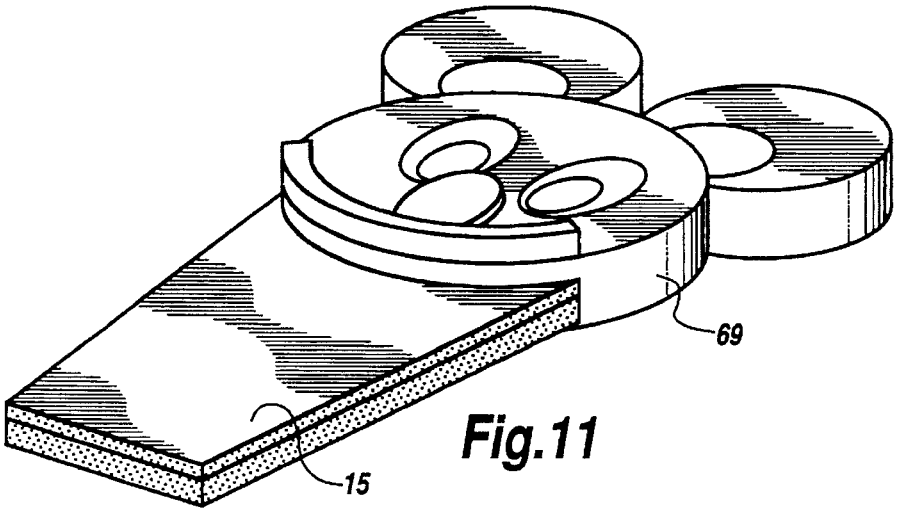
FIG. 11 is a perspective view of an alternative embodiment of the handle and container portion.

In order to make the hygiene toilet seat handle 11 more attractive to children, the hygiene toilet seat handle 11 may have an alternative handle 69, as shown in FIG. 11. The alternative handle 69 may have the shape of a face of a favorite cartoon character or animal, for example.

Figure 12:
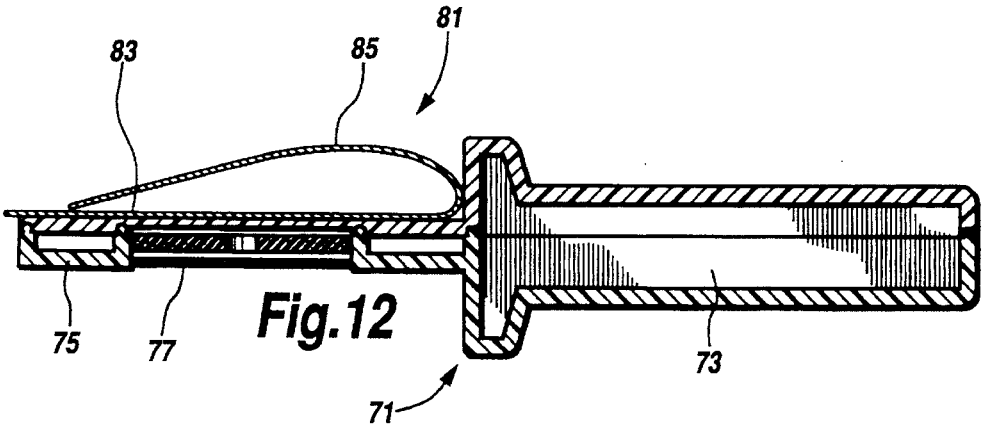
FIG. 12 is a cross-sectional side view of an alternative embodiment of the hygiene toilet seat handle.
Figure 13:
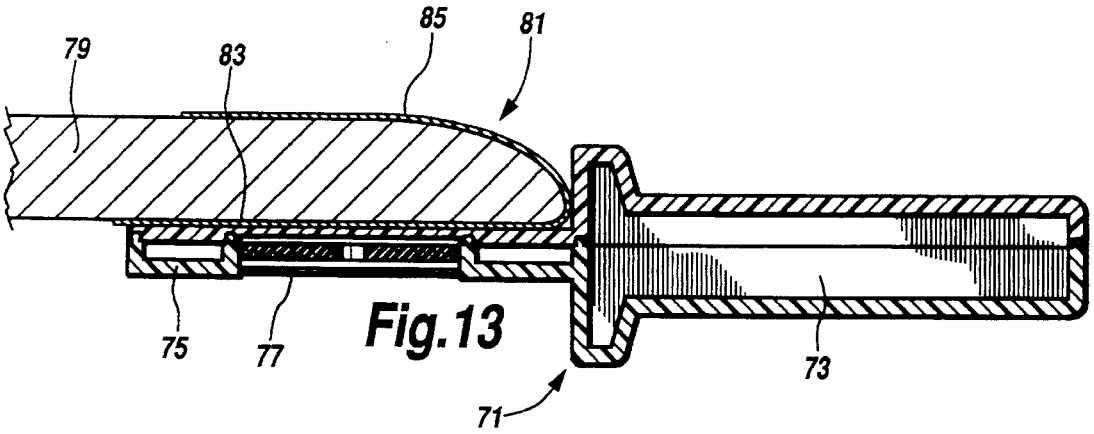
FIG. 13 is a cross-sectional side view of the embodiment shown in FIG. 12, with the hygiene toilet seat handle installed on a standard toilet seat.

Another alternative embodiment is illustrated in FIGS. 12 and 13. In this embodiment, the hygiene toilet seat handle 71 has a handle 73 and a wafer container 75, similar to the first embodiment. The wafer container 75 holds a standard deodorizing or disinfecting wafer 77.

The difference in this embodiment is the means for attaching the wafer container 75 to the toilet seat 79. In this embodiment, the means for connecting the wafer container 75 to the toilet seat 79 is a resilient spring clamp 81. The clamp 81 has a foldover cross-sectional configuration substantially corresponding to a cross-sectional configuration of an upper and lower surface of the toilet seat 79. The spring clamp 81 imposes a spring grip relation against the upper and lower surfaces of the toilet seat 79. The spring clamp 81 has a lower arm 83 and upper arm 85, connected at one end to be biased towards one another.

The lower arm 83 of the spring clamp 81 either integral with the wafer container 75, or attached to the wafer container 75 by an adhesive. The spring clamp 81 is plastic or rubber coated, and may have a small amount of adhesive on its inner surface in order to strengthen the spring clamp's grip on the toilet seat 79. However, the hygiene toilet seat handle 71 remains easy to remove and replace on the toilet seat 79.

The hygiene toilet seat handle of the invention has several advantages over the prior art. The hygiene toilet seat handle of the invention provides a sanitary, easy way to raise and lower a toilet seat or cover. In addition, the hygiene toilet handle may be treated or coated with a disinfectant hygiene type substance. Further, the glow in the dark aspect to the handle allows a person to easily see whether the toilet seat is up or down, even in the dark. Also, the wafer container is easily opened and closed, or accessible, so that the wafer can be easily replaced.

The invention has been described in only a few embodiments. It should be apparent to those skilled in the art that the invention is not so limited, but is susceptible to various changes and modifications without departing from the spirit of the invention.

I claim:

1. A toilet seat handle, comprising:

a wafer container for holding a wafer;

a handle, connected to the wafer container; and a resilient spring clamp secured to the wafer container for removably attaching the container to a toilet seat, the clamp having a foldover cross-sectional configuration substantially corresponding to a cross-sectional configuration of an upper and lower surface of a toilet seat to which the container is to be attached by imposing a spring grip relation against the upper and lower surfaces of the toilet seat, the clamp having a lower arm attached to the wafer container and an upper arm attached at one end to the lower arm, wherein the upper arm and lower arm fit on opposite sides of a toilet seat, so as to locate the wafer container below the toilet seat with the handle extending outward beyond one edge of the toilet seat.

2. A hygiene toilet seat handle, as recited in claim 1, wherein the wafer container has a plurality of holes for allowing the wafer to vaporize.

3. A hygiene toilet seat handle, as recited in claim 1, further comprising a portion of adhesive on the resilient spring clamp for reinforcing the attachment of the wafer container to the toilet seat.

4. A toilet seat handle, as recited in claim 1, wherein the upper arm and the lower arm are connected at one end to be biased toward one another.

5. A toilet seat handle, as recited in claim 1, wherein the wafer container has a planar upper surface and the lower arm of the spring lies flat against the upper surface of the wafer container.

6. A toilet seat handle, as recited in claim 1, wherein the upper arm and the lower arm are connected at one end to be biased toward one another and the connected end of the upper and lower arms is adjacent to the handle.

* * * * *